US008038403B2

(12) United States Patent
Lejars et al.

(10) Patent No.: US 8,038,403 B2
(45) Date of Patent: Oct. 18, 2011

(54) TURBOMACHINE ROTOR WHEEL

(75) Inventors: Claude Robert Louis Lejars, Draveil (FR); Nicolas Christian Triconnet, Saint Fargeau Ponthierry (FR); Frederick Thise, Boirs (BE)

(73) Assignee: SNECMA, Paris (FR)

( * ) Notice: Subject to any disclaimer, the term of this patent is extended or adjusted under 35 U.S.C. 154(b) by 908 days.

(21) Appl. No.: 11/670,509

(22) Filed: Feb. 2, 2007

(65) Prior Publication Data

US 2007/0183894 A1 Aug. 9, 2007

(30) Foreign Application Priority Data

Feb. 8, 2006 (FR) ..... 06 01098

(51) Int. Cl.
*F01D 5/30* (2006.01)
*F04D 29/34* (2006.01)

(52) U.S. Cl. ..... 416/215; 416/248

(58) Field of Classification Search ..... 416/215, 416/220 R, 221, 248
See application file for complete search history.

(56) References Cited

U.S. PATENT DOCUMENTS

| | | | | |
|---|---|---|---|---|
| 4,878,811 | A * | 11/1989 | Jorgensen | 416/215 |
| 5,078,576 | A * | 1/1992 | Hayton | 415/209.3 |
| 5,211,536 | A * | 5/1993 | Ackerman et al. | 415/177 |
| 5,445,499 | A * | 8/1995 | Charbonnel | 416/220 R |
| 6,095,750 | A * | 8/2000 | Ross et al. | 415/189 |
| 6,375,429 | B1 | 4/2002 | Halila et al. | |
| 6,565,322 | B1 * | 5/2003 | Lieser et al. | 416/219 R |
| 7,080,974 | B2 * | 7/2006 | Lejars et al. | 416/215 |
| 7,334,331 | B2 * | 2/2008 | Bouchard et al. | 29/889.23 |
| 2004/0086387 | A1 | 5/2004 | Fitts et al. | |

FOREIGN PATENT DOCUMENTS

| | | |
|---|---|---|
| EP | 0 280 246 A1 | 8/1988 |
| FR | 2 013 754 | 4/1970 |
| FR | 2 504 975 | 11/1982 |

* cited by examiner

*Primary Examiner* — Edward Look
*Assistant Examiner* — Sean J Younger
(74) *Attorney, Agent, or Firm* — Oblon, Spivak, McClelland, Maier & Neustadt, L.L.P.

(57) ABSTRACT

A turbomachine rotor wheel includes a disk carrying blades having roots engaged and held in an annular recess of the disk. The roots are connected to platforms for co-operating with an annular gasket mounted in an annular groove of the disk. The annular sealing gasket exerts a resilient force on the blade platforms holding the blades in a proper position for operation while the turbomachine is at rest.

7 Claims, 3 Drawing Sheets

TURBOMACHINE ROTOR WHEEL

The present invention relates to a rotor wheel, in particular for a turbomachine, the wheel comprising a disk carrying blades having roots that are mounted in an annular recess in an outer peripheral surface of the disk.

BACKGROUND OF THE INVENTION

The blade roots are inserted into the recess through a window in a side wall of the recess, and they are then moved circumferentially along the recess so as to be held radially and axially relative to the axis of the wheel by means of co-operating shapes, the recess being of a cross-section that is in the shape of a dovetail or the like, and the blade roots having a shape that is complementary to that of the recess.

The blade roots are connected to the airfoils of the blades by platforms that, when the blades are mounted in the groove and juxtaposed circumferentially, surround the peripheral surface of the disk externally.

Manufacturing and assembly tolerances mean that the blade roots are received with clearance in the annular recess of the disk.

In operation, the blades are subjected to high levels of centrifugal force and they adopt a proper angular position relative to the axis of the rotor, in which position the radial clearance between the outer ends of the blades and an outer annular casing are minimized so as to improve the performance of the turbomachine.

An elastomer annular gasket is generally mounted in an annular groove in the peripheral surface of the disk, upstream and/or downstream of the blades, under the blade platforms, and having, in the free state, an outside diameter that is less than or equal to that of its mounting groove so as to avoid impeding the circumferential sliding of the blades in the annular recess of the disk.

In operation, the gasket expands radially outwards under the effect of centrifugal force and comes into contact with the blade platforms so as to damp blade vibration and/or to prevent air from passing between the platforms and the outer peripheral surface of the disk, since that would reduce the performance of the turbomachine.

When the turbomachine is at rest, and on starting, the blades of the wheel can tilt to a greater or lesser extent relative to their operating position, and their ends might rub against the outer casing, thereby deteriorating the blades and reducing the performance of the turbomachine.

OBJECTS AND SUMMARY OF THE INVENTION

A particular object of the invention is to provide a solution to this problem that is simple, inexpensive, and effective.

The invention provides a rotor wheel having blades that are held substantially in the same position relative to the axis of the rotor, not only in operation, but also at rest and on starting.

To this end, the invention provide a rotor wheel, in particular for a turbomachine, the wheel comprising a disk carrying blades having roots engaged and held in an annular recess in an outer peripheral surface of the disk, the roots being connected to platforms surrounding the outside of the outer peripheral surface of the disk and designed to co-operate with an annular sealing gasket mounted in an annular groove of the outer peripheral surface of the disk, wherein, at rest, the annular gasket exerts a resilient force on the blade platforms holding the blades in a proper position for operation, the annular gasket in the free state having an outside diameter greater than that of its mounting groove, and its hardness being determined so as to urge the blades into their proper position for operation and so as to allow the blades to be moved circumferentially in their annular mounting recess.

When the turbomachine is in operation, the annular gasket damps blade vibration and/or prevents air from passing between the blade platforms and the peripheral surface of the disk, and while the turbomachine is at rest or on starting, the same gasket serves to position the blades properly to prevent their ends rubbing against the outer casing.

When the root of a blade is inserted into the annular recess of the disk through the window, the platform of the blade comes into contact with the annular gasket and deforms it locally. The hardness of the annular gasket is determined so that the return force exerted by the gasket on the blade is weak enough to allow the blade to be moved circumferentially along the recess, and strong enough to ensure that the blade is properly positioned once it is mounted in the recess.

The shape of the gasket is preferably symmetrical about its transverse midplane, thus making it easier to fabricate and preventing the gasket being mounted the wrong way round in the annular groove of the disk.

According to another characteristic of the invention, the gasket has at least one outer peripheral lip for projecting out from the groove when the gasket is mounted in the groove. This lip comes into contact with the blade platforms mounted on the disk and serves both to position the blades properly while the turbomachine is at rest and on starting, and to provide sealing between the blade platforms and the peripheral surface of the disk and/or damping of blade vibration while the turbomachine is in operation.

The gasket may also have at least one inner peripheral lip for bearing against the bottom of the groove when the gasket is mounted in the groove.

In an embodiment of the invention, the annular gasket has a section that is substantially of parallelogram or lozenge shape, with a radially inner lip or a radially outer lip constituted by a vertex thereof.

In another embodiment of the invention, the annular gasket has a section that is substantially X-shaped or H-shaped.

The present invention also provides an annular gasket for a rotor wheel as described above, the gasket having, in the free state, an outside diameter greater than the outside diameter of its annular mounting groove, and hardness on the Shore A scale lying in the range 50 to 100, e.g. equal to 75. The gasket is made of "Viton A" or of "Viton B", for example.

The annular gasket may be a sealing gasket and/or a vibration-damper gasket.

The invention also provides a turbomachine compressor including at least one rotor wheel as described above, and a turbomachine, such as an aircraft turbojet or turboprop, the turbomachine including at least one rotor wheel as described above.

BRIEF DESCRIPTION OF THE DRAWINGS

The invention can be better understood and other characteristics, details, and advantages of the invention appear on reading the following description made by way of non-limiting example with reference to the accompanying drawings, in which.

MORE DETAILED DESCRIPTION

Figure 1:
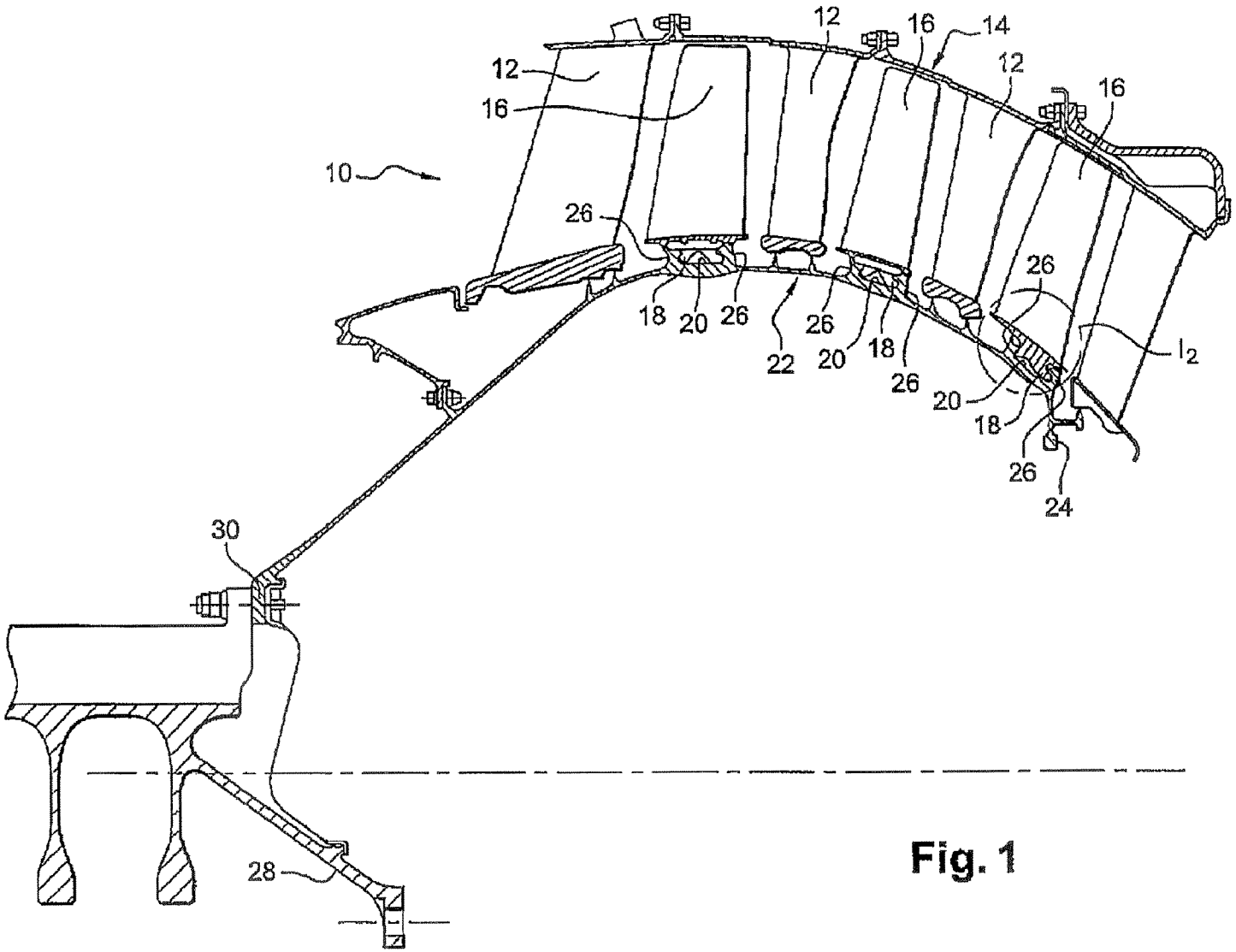
FIG. 1 is a diagrammatic half-view in axial section of a low pressure compressor of a turbomachine, including a prior art rotor wheel.

The low pressure compressor 10 of FIG. 1 has three compression stages, each of these stages having a stationary annular row of stator vanes 12 having their radially outer ends carried by an outer annular casing 14, and an annular row of moving blades 16, arranged downstream from the annular row of stator vanes 12, and having their roots 18 mounted in an annular recess 20 in the outer peripheral surface of a disk 24 of a rotor wheel.

In the example shown, the disk 24 comprises a circularly symmetrical wall 22 having outer annular ribs 26 with the annular recess 20 for mounting the rows of moving blades 16 being defined between them.

The disk 24 is connected to a shaft of the turbomachine (not shown) via a drive cone 28 secured to an upstream annular flange 30 of the circularly symmetrical wall 22 of the disk.

In conventional manner, each recess 20 has a cross-section of the dovetail or similar type and includes a window (not shown) through which the roots 18 of the blades 16 are inserted, which roots are complementary in shape to the shape of the recess 20.

Figure 2:
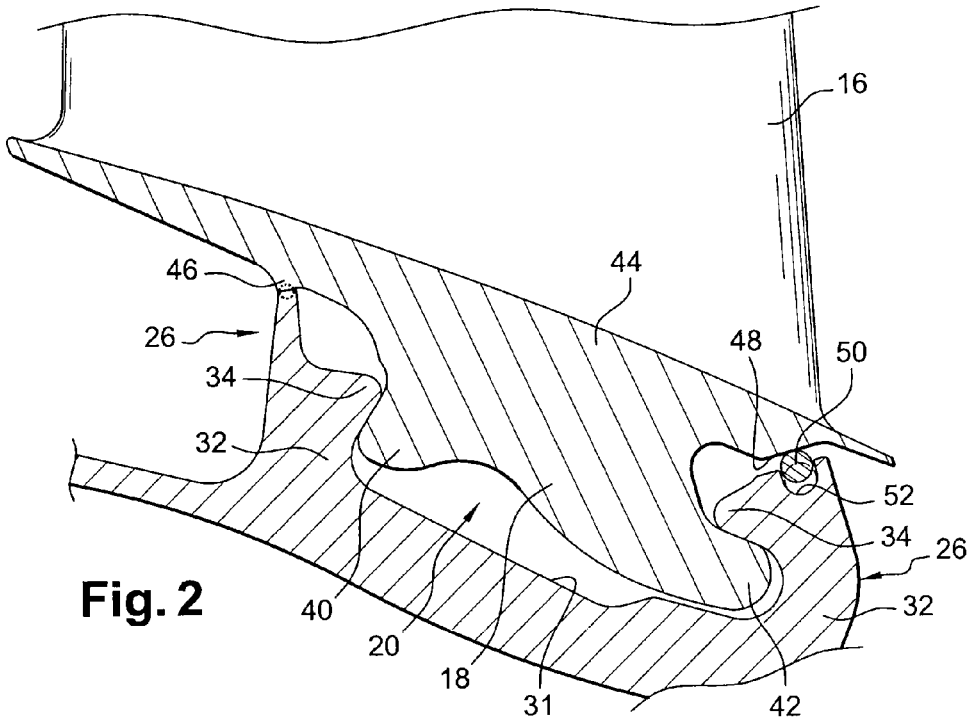
FIG. 2 is an enlarged view of detail $I_2$ of FIG. 1.

As can be seen better in FIG. 2, the recess 20 of the disk 24 includes an annular bottom 31 that extends between two side walls 32 each having an axial annular rim 34 extending substantially towards the opposite side wall 32. The window for inserting the blade roots 18 is formed, for example, in a side wall 32 of the recess or by cutting away the annular rims 34 of the recess.

The blade roots 18 have upstream rims 40 and downstream rims 42 extending in circumferential manner around the axis of the rotor and serving to be received between the bottom 31 of the recess and the annular rims 34 of the recess, and to co-operate therewith by abutment so as to hold the blades 16 radially and axially on the disk relative to the axis of the rotor.

The blades 16 (e.g. 62 in number) are inserted into the annular recess 20 of the disk one after another and they are juxtaposed circumferentially around the axis of the rotor. The blade roots 18 are connected to the airfoils of the blades by platforms 44 which are in circumferential alignment with one another and surround the outside of the annular ribs 26.

Manufacturing and assembly tolerances mean that the blade roots 18 are mounted with clearance in the recess 20 of the disk.

In the example shown, the radial clearance between the radially outer end of a downstream rib 26 and the corresponding portion of the blade root or of the platform 44 may be as much as 0.15 millimeters (mm) for an annular recess 20 having an outside diameter of about 1.20 meters (m).

When the turbomachine is in operation, the blades 16 are subjected to high levels of centrifugal force and they take up an upright angular position relative to the axis of the rotor, in which position the downstream rim 42 of the blade roots come into abutment against the rim 34 of the downstream wall 32 of the recess (FIG. 2), and the platforms 44 of the blades bear against the outer periphery of the upstream wall 32 of the recess and are spaced apart from the outer periphery of the downstream wall 32 of the recess, with the radial clearance between the outer ends of the blades 16 and the outer casing 14 then being minimized in order to improve the performance of the turbomachine.

The inner surface of the platform 44 of each blade has an annular rib 46 projecting towards the axis of the rotor that engages the outer periphery of the upstream wall 32 of the recess, as can be seen in FIG. 2.

A one-piece annular elastomer gasket 50 of circular section is mounted in an annular groove 52 in the outer periphery of the downstream side wall 32 of the recess, this groove 52 opening out radially outwards under the downstream ends 48 of the blade platforms.

When in its free state, the gasket 50 has an outside diameter that is less than or equal to that of the groove 52 (as shown in dashed lines in FIG. 2), and when the turbomachine is at rest it is housed entirely in the groove. The gasket 50 may be a sealing gasket and/or a gasket for damping vibration.

When the turbomachine is in operation, the gasket 50 expands radially outwards under the effect of centrifugal force and bears against inner downstream surfaces 48 of the blade platforms (as shown in continuous lines), thereby preventing air from passing between the blade platforms and the outer periphery of the downstream wall 32 of the recess, and/or exerting pressure on the platforms and damping blade vibration.

When the turbomachine is at rest and while it is starting, the blades 16 of the wheel tilt forwards slightly and adopt a different angular position relative to the rotor axis, with the downstream rim 42 of the blade roots bearing against the bottom 31 of the recess so that the radially outer ends of the blades 16 might come into contact with the outer casing 14, thereby running the risk of damaging the blades on starting and when the turbomachine is at rest, and thus reducing the performance of the turbomachine.

The invention solves this problem by an annular gasket mounted in the groove 52 that makes it possible when the turbomachine is at rest to exert a resilient force on the blade platforms 44 urging the blades 16 towards their operating position in which the ends of the blades are spaced apart from the outer casing 14 and cannot rub thereagainst.

Figure 3:
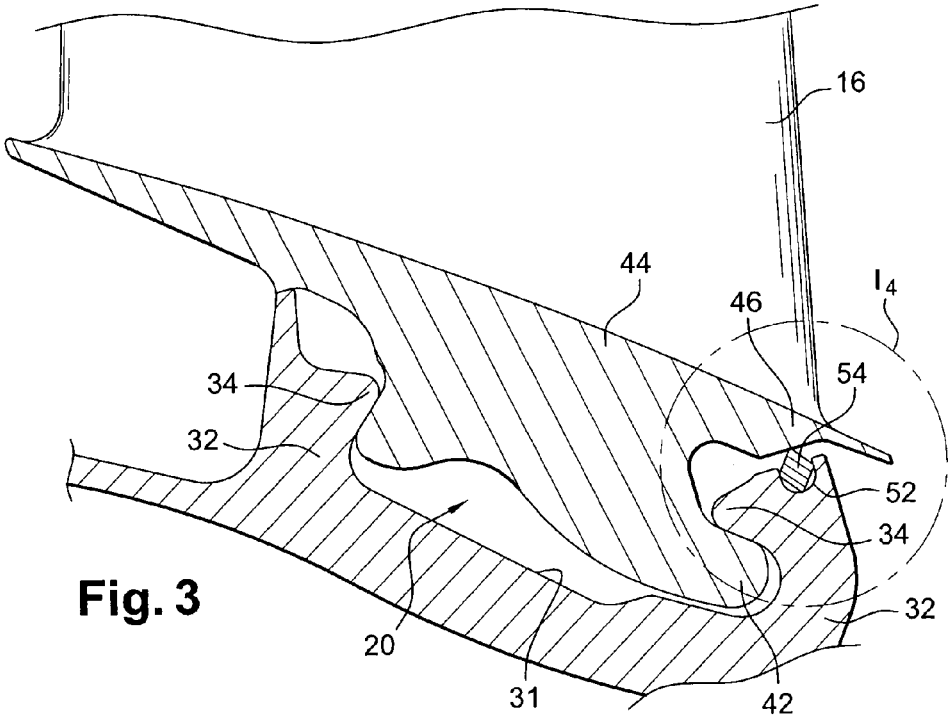
FIG. 3 is a diagrammatic view corresponding to FIG. 2 and showing an embodiment of a rotor wheel of the invention.
Figure 4:
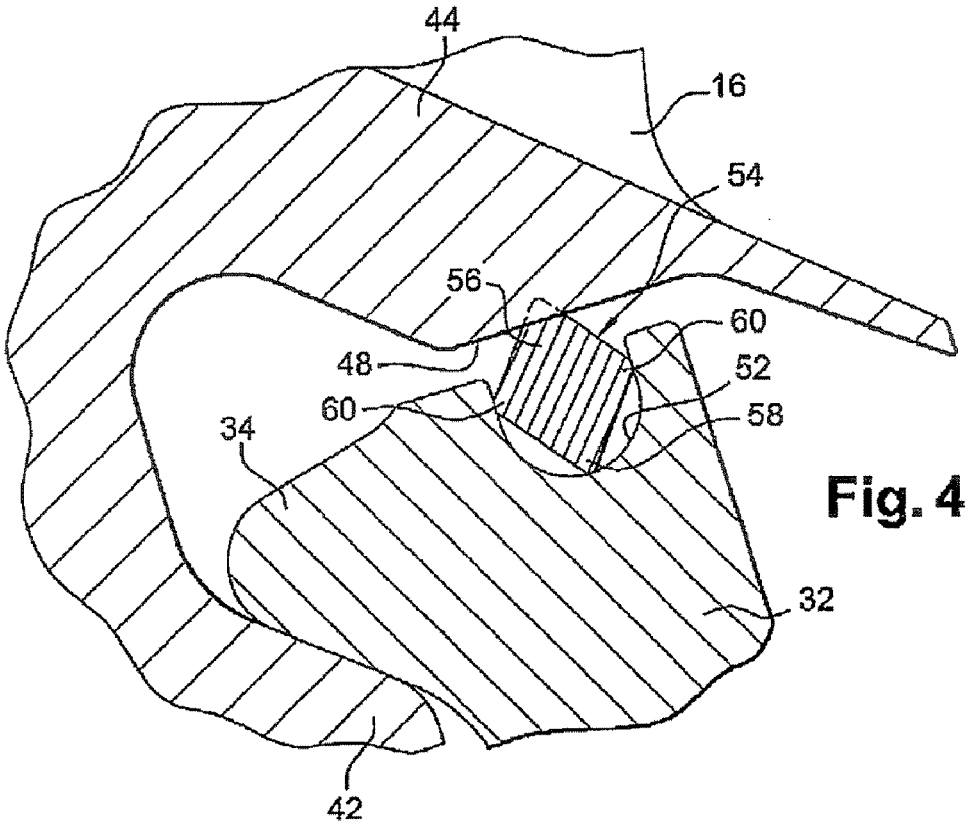
FIG. 4 is an enlarged view of detail $I_4$ of FIG. 3.

In a first embodiment shown in FIGS. 3 and 4, the gasket 54 presents a substantially lozenge-shaped section, having an outer peripheral lip 56 of triangular section for projecting out from the groove 52 to bear against the inner downstream surfaces 48 of the blade platforms, and an inner peripheral lip 58 of triangular section for bearing against the bottom of the groove 52 when the gasket 54 is mounted in the groove. The upstream and downstream edges 60 of the gasket 54 are designed to bear against the side walls of the groove 52.

The dimensions and the hardness of the gasket 54 are determined so that firstly the blades 16 of the wheel adopts substantially the same angular position when the turbomachine is at rest and when it is operation, and secondly the gasket 54 does not prevent the blade roots 18 being inserted into the recess 20 in the disk, and does not prevent the blades being moved circumferentially along the recess with the surfaces 48 of the platforms rubbing against the gasket 54. As can be seen in FIG. 4, the gasket 54 is elastically deformed between the platforms of the blades and the bottom of the groove 52, and it exerts on the platforms a return force for ensuring that the blades are properly positioned.

In an embodiment of the invention, the annular gasket 54 has an outside diameter of about 1.20 m, hardness on the Shore A scale lying in the range 50 to 100, e.g. equal to about 75, and capable of withstanding temperatures that may be as great at 150° C. By way of example, the gasket is made of "Viton A" or "Viton B".

Figure 5:
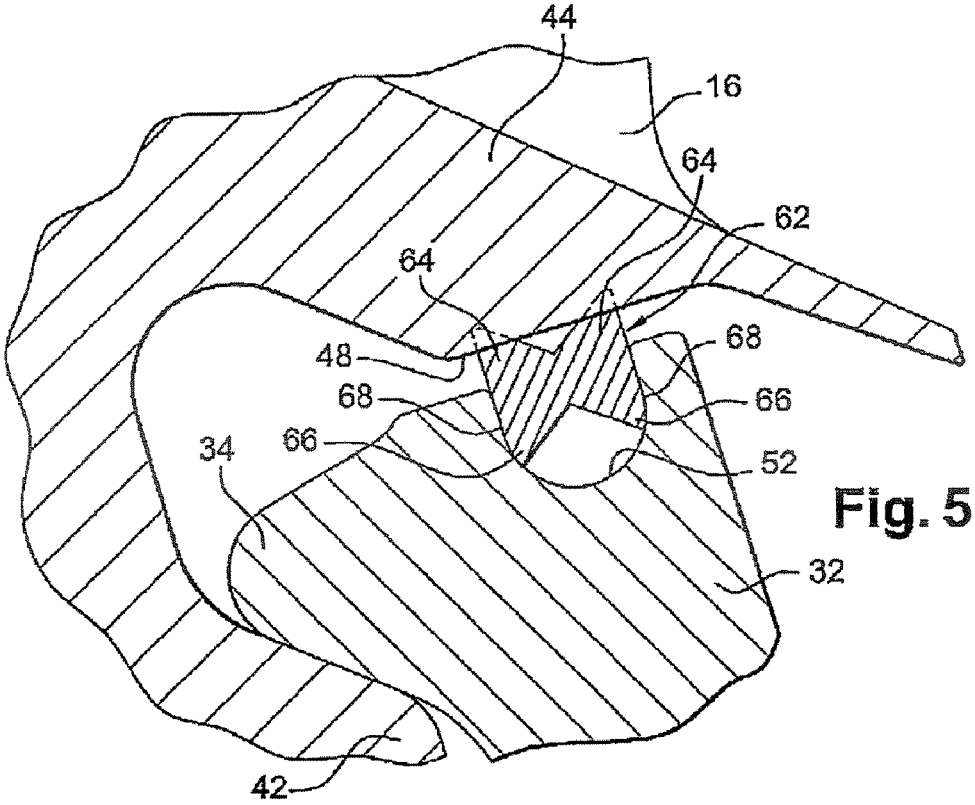
FIG. 5 is a diagrammatic view corresponding to FIG. 4 and showing a variant embodiment of the invention.

In another embodiment shown in FIG. 5, the gasket 62 has a cross-section that is substantially X-shaped or H-shaped with two outer peripheral lips 64 projecting out from the groove 52 to bear against the downstream inner surfaces 48 of the blade platforms, and two inner peripheral lips 66 whose upstream and downstream side surfaces 68 are substantially plane and parallel and bear against the side walls of the grove 52 when the gasket 62 is mounted in the groove 52. The gasket 62 is deformed elastically between the platforms of the blades and the bottom of the groove 52 and it exerts a return force on the platforms to ensure that the blades are properly positioned.

When the gasket 54 or 62 is mounted in the groove 52 of the disk, it does not occupy the entire volume of the groove, as can be seen in FIGS. 4 and 5. When the root 18 of a blade is inserted in the recess 20, the platform 44 of the blade bears against the gasket 54, 62 which is compressed a little towards the inside of the groove 52.

Naturally, the invention is not limited to the embodiments described above and shown in FIGS. 3 to 5. For example, the gasket 54 or 62 which is preferably symmetrical in shape about its middle transverse plane, could present a section having a shape that is different from those shown.

Furthermore, the gasket 54 or 62 could be mounted in an annular groove of the upstream side wall 32 of the recess, said groove opening out under the upstream portions of the blade platforms 44.

What is claimed is:

1. A rotor wheel for a turbomachine, the wheel comprising:

a disk carrying blades having roots engaged and held in an annular recess in an outer peripheral surface of the disk, an outer annular surface of the outer peripheral surface of the disk having an upstream outer annular surface and a downstream outer annular surface located upstream and downstream from said annular recess, respectively, the roots being connected to platforms surrounding the outside of the outer peripheral surface of the disk and designed to co-operate with an annular sealing gasket mounted in an annular groove of the downstream outer annular surface of the outer peripheral surface of the disk, wherein, at rest, the annular gasket bears against inner surfaces of the blade platforms and exerts a resilient force on the blade platforms so as to hold the blades in a proper position for operation in which said inner surfaces of the blade platforms are spaced from said downstream outer annular surface and in which said blade platforms are in abutment against said upstream outer annular surface of the outer peripheral surface of the disk, the annular gasket in the free state having an outside diameter greater than that of its mounting groove, and its hardness is determined so as to urge the blades into their proper position for operation and so as to allow the blades to be moved circumferentially in their annular mounting recess, wherein the gasket has a section that is substantially X-shaped or H-shaped, and includes two outer peripheral lips which project out from the groove and which abut against the blade platforms and two inner peripheral lips which bear against the bottom of the groove when the gasket is mounted in the groove, said gasket further comprising upstream and downstream flat annular surfaces which are parallel to upstream and downstream gasket surfaces of the groove and are in abutment against the upstream and downstream gasket surfaces.

2. A wheel according to claim 1, wherein the gasket is symmetrical in shape about its transverse midplane.

3. An annular sealing gasket for a rotor wheel according to claim 1, the gasket having, in the free state, an outside diameter greater than the outside diameter of its annular mounting groove and presenting hardness on the Shore A scale lying in the range 50 to 100.

4. A turbomachine compressor including at least one rotor wheel according to claim 1.

5. A turbomachine such as an airplane turbojet or turboprop, the turbomachine including at least one rotor wheel according to claim 1.

6. A wheel according to claim 1, wherein the hardness of the gasket is determined such that an angular position of the blades when the turbomachine is at rest is substantially the same as the angular position of the blades when the turbomachine is in operation.

7. A wheel according to claim 1, wherein inner surfaces of the blade platforms include an annular rib which projects towards an axis of the rotor and abuts against said upstream outer annular surface of the outer peripheral surface of the disk.

* * * * *